US005901956A

United States Patent [19]

Warmack

[11] Patent Number: 5,901,956

[45] **Date of Patent: *May 11, 1999**

[54] TEAM SPORT BOARD GAME

[76] Inventor: Tod L. Warmack, Rte. 7, Box 513B, Tallahassee, Fla. 32308

[ * ] Notice: This patent is subject to a terminal disclaimer.

[21] Appl. No.: 08/521,910

[22] Filed: Aug. 31, 1995

[51] Int. Cl.[6] ..... A63F 3/00

[52] U.S. Cl. ..... 273/244

[58] Field of Search ..... 273/236, 242, 273/243, 244–247, 259

[56] References Cited

U.S. PATENT DOCUMENTS

| | | | |
|---|---|---|---|
| 4,000,897 | 1/1977 | York | 273/93 C |
| 4,121,823 | 10/1978 | McBride | 273/243 X |
| 4,173,346 | 11/1979 | Godwin | 273/247 |
| 4,211,410 | 7/1980 | Smith | 273/94 |
| 4,261,569 | 4/1981 | Frohlich | 273/93 C |
| 4,776,593 | 10/1988 | DiPersio et al. | 273/93 C |
| 4,856,780 | 8/1989 | Begley et al. | 273/244 |
| 4,984,805 | 1/1991 | Medlock | 273/248 |
| 5,054,775 | 10/1991 | Banks et al. | 273/431 |
| 5,087,051 | 2/1992 | LoBue | 273/247 |
| 5,092,606 | 3/1992 | Miller | 273/249 |
| 5,123,653 | 6/1992 | Murphy et al. | 273/244 |
| 5,217,229 | 6/1993 | Jaime | 273/247 |
| 5,248,147 | 9/1993 | Smith | 273/244 |
| 5,273,431 | 12/1993 | Charouhas | 273/243 X |
| 5,415,412 | 5/1995 | McMahon | 273/244 |

FOREIGN PATENT DOCUMENTS

| | | | |
|---|---|---|---|
| 1469067 | 3/1977 | United Kingdom | 273/243 |

OTHER PUBLICATIONS

*The Ungame*, The Ungame Company, 3 pgs. Dec. 1984.

*Primary Examiner*—William E. Stoll
*Attorney, Agent, or Firm*—Carnes Conal Dixon

[57] ABSTRACT

A game simulating a team sport which tests and improves players' knowledge of, for example, favorite teams, whereby players select play cards and alternately ask and answer questions. Players generally advance teams and score by answering questions correctly. After answering questions correctly, players spin a move wheel, determining by chance move outcomes. Move outcomes include realistic possibilities, such as various numbers of yards to advance, interception by the opposing team exchanging defense and offense, number of penalty yards to retreat and awards of first downs or touchdowns. Players roll dice to begin play or attempt supplementary moves. Players mark scoreboards to record teams' changing scores. Scoreboards include play counters and question counters for convenience.

13 Claims, 3 Drawing Sheets

TEAM SPORT BOARD GAME

BACKGROUND OF THE INVENTION

1. Field of the Invention

The present invention relates generally to board games and more particularly to board games mimicking team sports, whereby players strive to advance a game piece and score by answering questions correctly and then spinning a wheel to determine the move's outcome. Players may roll dice to begin play or attempt supplementary moves.

2. Description of the Related Art

Board games attempting to simulate real play of particular team sports like baseball, basketball, football and hockey are popular and well known. People play these games for diversion and enjoyment.

U.S. Pat. No. 4,173,346 issued to Godwin discloses a football board game giving players choice between selecting cards or rolling dice to simulate results of conventional football games.

U.S. Pat. No. 4,211,410 issued to Smith discloses a football board game including dice, manually operated chance device, play selector and simulated football field with regularly spaced openings for receiving player pieces. Player(s) roll dice to determine yardage of a designated play. Player(s) operate a manually operated chance device to determine kick results, pass results and penalties.

U.S. Pat. No. 4,261,569 issued to Frohlich discloses a baseball board game consisting of a board having a baseball diamond, a realistic random number generator and two sets of cards for player identification and play event. Players generate random numbers and consult cards.

U.S. Pat. No. 4,776,593 issued to DiPersio et al. discloses a board game simulating baseball combining a die and playing cards with a video cassette recorder ("VCR"). Players roll die to determine pitch result. When die rolls indicate hits, players select cards to determine hit result. Cards may direct players to subsequently consult a VCR tape having recorded baseball plays.

U.S. Pat. No. 5,123,653 issued to Murphy et al. discloses a basketball board game including a miniature basketball goal and basketball, question and answer cards and means to determine by chance which questions player(s) use during player(s)' turns. Player(s) answering questions correctly make shots at the goal.

U.S. Pat. No. 5,217,229 issued to Jaime discloses a football board game including representation of a football field having goal and yard line indicia. Players roll various die (extra point, field goal, kick-punt and yardage), then consult associated charts.

U.S. Pat. No. 5,415,412 issued to McMahon discloses a baseball board game utilizing various dice and a sectored spinner. Player(s) roll dice to determine pitch result. When dice rolls designate hits, player(s) spin the spinner to determine hit type. Player(s) roll dice to determine steal attempt outcomes. Player(s) arrange common baseball cards on playing surface illustrations to pretend.

As evidenced by the above patents, various board games exist. However, new games are useful where unobvious combinations of new and old game elements renew player (s)' desire to purchase and play games. No known games comprise the board game elements included in the present invention. The differences between the subject matter sought to be patented and the prior art are such that the subject matter of the present invention as a whole would not have been obvious at the time the invention was made to a person having ordinary skill in the art to which the subject matter pertains.

BRIEF SUMMARY OF THE INVENTION

The present invention is a team sport board game modeled to a team sport that can be played by at least two players. The game of the present invention includes a playing board, a game piece, dice, spin wheel, and a plurality of playing cards, each containing several questions and corresponding correct answers.

The playing board, is designed and configured to depict the field one which the game will be played. In the preferred embodiment, the board symbolizes a football field. However, other fields, such as basketball, hockey, soccer, or the like, can be depicted. The playing board is fabricated to depict an actual playing field. For example, with a football game, the board would include boundary lines, end zones, goal lines and a plurality of yardage lines, equally spaced between the goal lines. An indicating means, such as the letter "G" may be used to identify the goal lines. For a more realistic portrayal of a football field, counting from the goal line, numerals "10", "20", "30", "40" and "50" for identifying the appropriate yardage lines.

Located at opposite ends of the playing board is a receptacle which is adapted to accept a team banner to identify and promote favorite teams. This playing board includes opposite ends, each having a receptacle that is adapted to accept a banner. The banners are designed to depict a particular collegiate or professional team. This design and configuration will enable the game to be customized and to add to the excitement and pleasure of the game.

At the start of play, after players have divided into teams, a coin, or other means of selecting the order of play by chance, is utilized to identify a kicking team (defensive) and a receiving team (offensive). Following the rules in professional or collegiate football, teams reverse kicking and receiving stations when second half of play begins.

Player(s) on receiving teams may roll the dice to measure attempted kickoff returns. Optionally, the player(s) may elect not to roll the dice and begin at a predetermined yard line.

Play cards may contain questions and corresponding correct answers concerning unlimited subjects. Preferably play cards contain questions and correct answers concerning trivia surrounding players' favorite teams of the sport modeled, such as the team depicted on the banner. After a kickoff not resulting in a touchdown, defensive player(s) asks the offensive player(s) a question. Offensive player(s) offering the correct answer spin a spinning arrow connected to the wheel to determine move's outcome.

The wheel comprises a circle having a plurality of sectors. Each sector contains an indicium which represents an appropriate move outcome. Move outcomes preferably include realistic possibilities. For example, move outcome possibilities for football games include: various numbers of yards to advance, interception by the defensive team where roles of defensive and offensive player(s) swap, number of penalty yards to retreat, and awards of first downs or touchdowns. The number, position and size of each of the plurality of sectors of the circle preferably corresponds to expected consequences of professional or collegiate team sport play. Players consult a ledger on the wheel for analysis of the indicium of move outcome.

Like professional or collegiate football, offensive players consume four downs attempting to score or obtain first downs. A down comprises one of the plurality of questions asked and answered or one roll of the dice. Offensive player(s) offering three correct answers to questions asked by defensive player(s) during one "possession" of four downs earn a first down. Move outcomes from the wheel may yield a first down.

Player(s) may attempt field goals or punts by rolling the dice. Yardage travel for punts is determined by the addition of the numerals on a roll of the dice multiplied by five. Punts may travel a maximum of sixty yards where a roll of the dice equals "12." Like professional or collegiate football, opposing teams resume play on the "20" yard line after punts that travel into end zones.

Field goal attempts travel yardage equaling the addition of the numerals on a roll of the dice multiplied by five. Offensive teams earn three points by "kicking" field goals traveling at least ten yards into the end zone. Like professional or collegiate football, opposing teams resume play from where field goals are attempted after failed field goals.

Players record move outcomes from either rolls of the dice or spins of the spinning arrow of the yardage wheel by placing a game piece on appropriate yardage lines.

Defensive player(s) earn two points for safeties when move outcomes place offensive teams in offensive end zones. Offensive teams earn touchdowns, which, again, award six points like professional or collegiate football, for traveling into the defensive end zones. After touchdowns, offensive teams may earn extra points, which award one point like professional or collegiate football, by rolls of the dice not equaling seven. Offensive teams may earn conversions, which award two points like professional or collegiate football, by matching calls of even or odd to rolls of the dice.

Offensive player(s) and defensive player(s) swap roles when offensive player(s) fail to earn a first down or a touchdown. Absent a punt, defensive player(s) accept "possession" where offensive player(s) leave the game piece.

A scoreboard enables the players to record changing plays, questions answered correctly and scores by appropriately altering a down counter and a question counter and writing scores. Preferably, player(s) write with erasable tools like chalk, dry-erase markers, graphite pencils or grease pencils.

Accordingly, it is an object of the present invention to provide a new board game mimicking team sport games for the diversion and enjoyment of player(s).

It is another object of the present invention to provide a game which tests and improves player(s)' knowledge of favorite teams or other subjects by having player(s) alternately ask and answer questions for which corresponding correct answers are provided.

It is yet another object of the present invention to provide a game where player(s) intent on scoring attempt to move a game piece towards a goal with statistically similar consequences to professional or collegiate team sport play.

The foregoing outlines some of the more pertinent objects of the present invention. These objects should be construed to be merely illustrative of some of the more prominent features and application of the present invention. Other beneficial results and enjoyment may be obtained by applying the disclosed invention in different manners or by modifying the invention within the scope of the disclosure. Accordingly, a fuller understanding of the present invention may be had by referring to the detailed description of the preferred embodiments, the accompanying drawings and the scope of the invention defined by the claims.

BRIEF DESCRIPTION OF DRAWINGS

Similar reference numerals refer to similar parts throughout the views of the drawings.

DESCRIPTION OF PREFERRED EMBODIMENT

Figure 1:
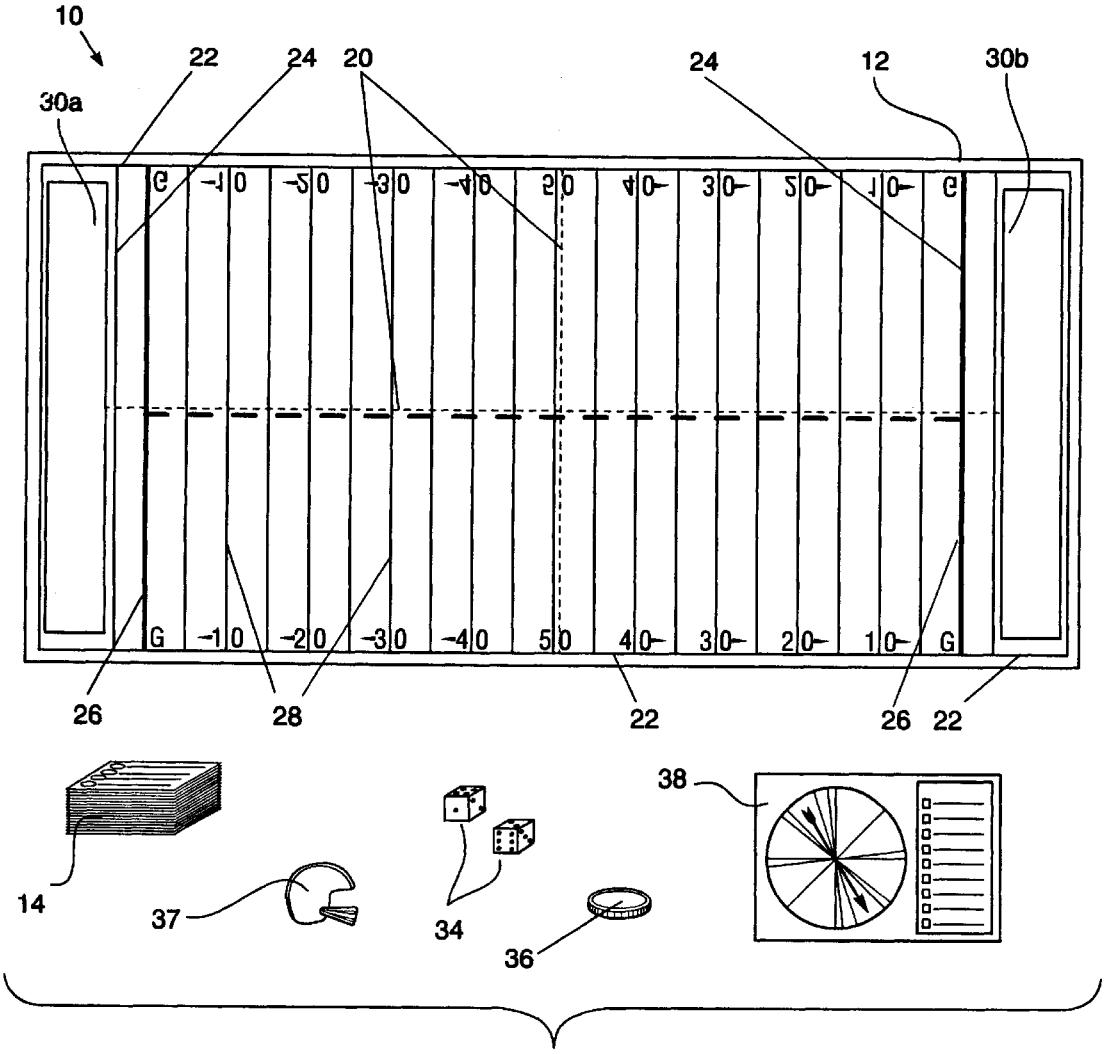
FIG. 1 is a perspective view illustrating various components in accordance with a presently preferred embodiment of the present invention.

The basic equipment and elements of the team sports game 10 are shown in FIG. 1. As seen, the team sports game 10 is modeled to professional or collegiate football and includes a playing board 12, play cards 14, dice 34, tossing element 36, playing piece 37 and a spinning wheel 38.

The playing board 12, symbolizing a professional or collegiate football field, is preferably manufactured of cardboard, paperboard or other sheet material, and includes scored lines 20 so players may fold the playing board 12, reducing the area occupied during storage. Optionally, the board can be fabricated from a flexible yet sturdy material, such as felt, plastic, or the like, so as to eliminate the need of score lines. The playing board 12 includes visible boundary lines 22, end zones 24, goal lines 26 and a plurality of evenly spaced yardage lines 28, located between the goal lines. An indicator, such as the letter "G", as illustrated in this preferred embodiment, goal post, or a combination thereof can be utilized to identify each of the goal lines 26. For a more realistic portrayal of a football field, every other yardage line 28 can be visibly numbered as "10", "20", "30", "40" and "50", respectively, for identifying and representing the appropriate yardage for that particular line.

Figure 2:
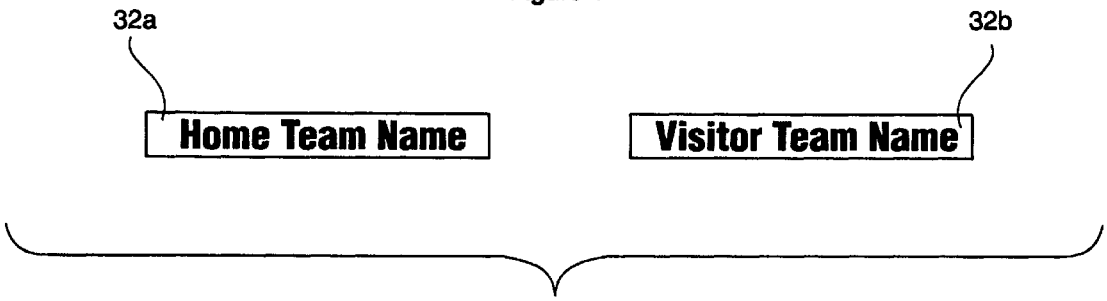
FIG. 2 is a plan view of the banners used in accordance with a presently preferred embodiment of the present invention.

A receptacle 14 is located at each end of the playing board 12. These receptacles 30*a* and 30*b* are adapted to receive and maintain a team banner 32*a* or 32*b* for identifying and promoting favorite teams. As seen in FIGS. 1 and 2, these banners 32*a* and 32*b*, are generally rectangular in shape and can include logos, mascots, names, designs, and pictures, in order to better illustrate the team. These banners are preferably manufactured from cardboard, Bristol board, paperboard, or other sheet material, and are designed to be easily and quickly removably insertable into the receptacles.

Logos may also be located on various places on the playing board 12, particularly in the center, which may be used to aid in the identification, advertisement and promotion of football, generally, football organizations, football teams or other appropriate entities, persons or products.

Figure 3:
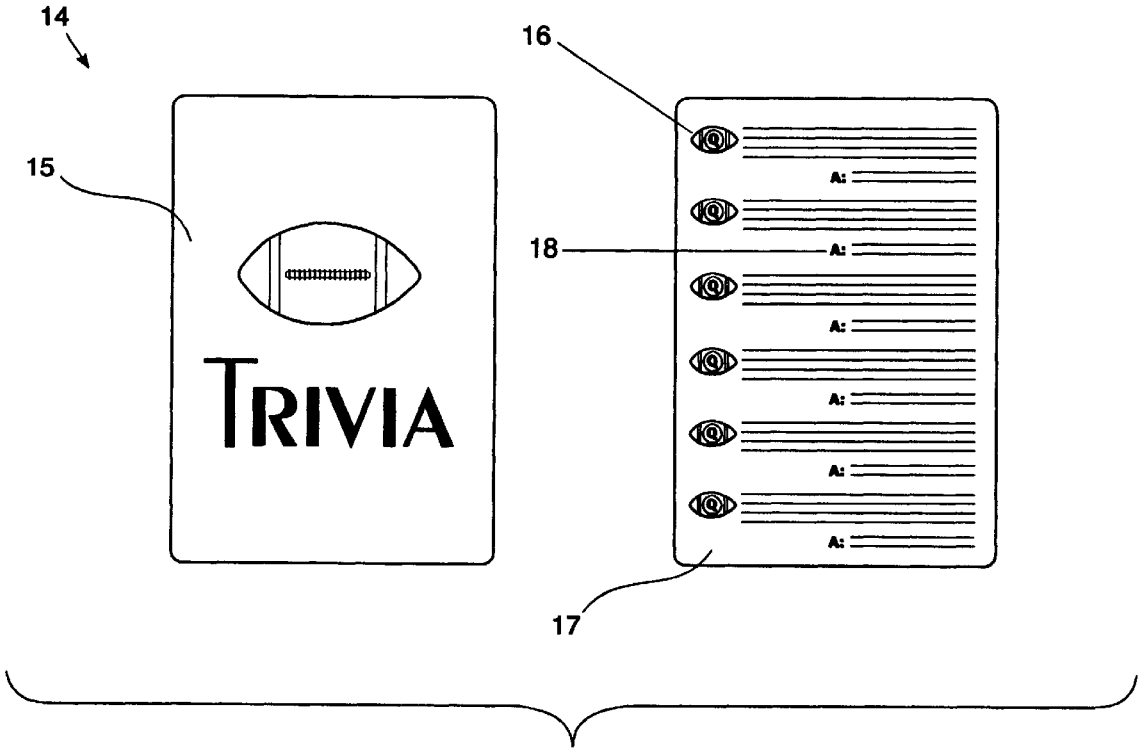
FIG. 3 is a plan view of an example of a play card used in accordance with a presently preferred embodiment of the present invention.

The playing cards 14, which are illustrated in FIGS. 1 and 3, each include a front surface 15 and a back surface 17. The front surface may be blank or have any desired design as illustrated. The back surface 17 includes a plurality of questions 16 and a corresponding plurality of correct answers 18. These playing cards 14 may contain questions 16 and correct answers 18 concerning unlimited subjects. Preferably playing cards 14 contain questions 16 and correct answers 18 concerning trivia surrounding players' favorite teams of the sport modeled (i.e., the team depicted on the banner).

If questions from the cards are correctly answered, then the game piece 37 may be advanced by the player(s). In order to do so, the player answering the question correctly spins the play wheel 38. This play wheel will determine the move's outcome. This play wheel 38 is illustrated in further detail in FIGS. 1 and 4. As seen, the wheel includes a flat circular region 42 that is divided into a plurality of sections or sectors 44. Each sector 44 of the circle 42 contains an indicium 54 (illustrated in FIG. 4 as "A", "B", "C", "D", "E", "F", "G", "H", "I", "J", and "K"). Each indicium represents a particular move that is disclosed and defined in a ledger 46. Move outcomes preferably include realistic possibilities. For example, move outcome possibilities for football games include: various numbers of yards to advance ("A"–"G"), interception ("H") by the defensive team where roles of defensive and offensive players swap, number of penalty yards ("I") to retreat, and awards of first downs ("J") or touchdowns ("K"). The number, position and size of each of the plurality of sectors 44 of the circle 42 preferably corresponds to expected consequences of professional or collegiate team sport play. For example, for the football game that is portrayed in these figures, there is included several sectors for 5 yard moves (see "A"). In professional or collegiate football, five yards can easily be achieved, and as such, these regions or sectors are typically larger in size and more frequent in number than the other regions or sectors, such as an interception (sector labeled "H"). The total size of all the sectors labeled "A" should cover the most surface area of the circle 42. Other moves, such as interceptions ("H"), penalties ("I"), and touchdowns ("K") are less likely to occur, and, as such, are provided on the sectors in fewer numbers and less surface area.

The wheel also includes a spinning arrow 40 that is centrally located thereto via a pin or rivet 50, to enable the arrow 40 to rotate or spin freely about the point of attachment. The arrow 40 includes a pointer end 48. This pointer end 48, once stopped, points to a particular sector to determine the move's outcome. The arrow 40 may be spun manually by the team once a correct answer is given.

Figure 4:
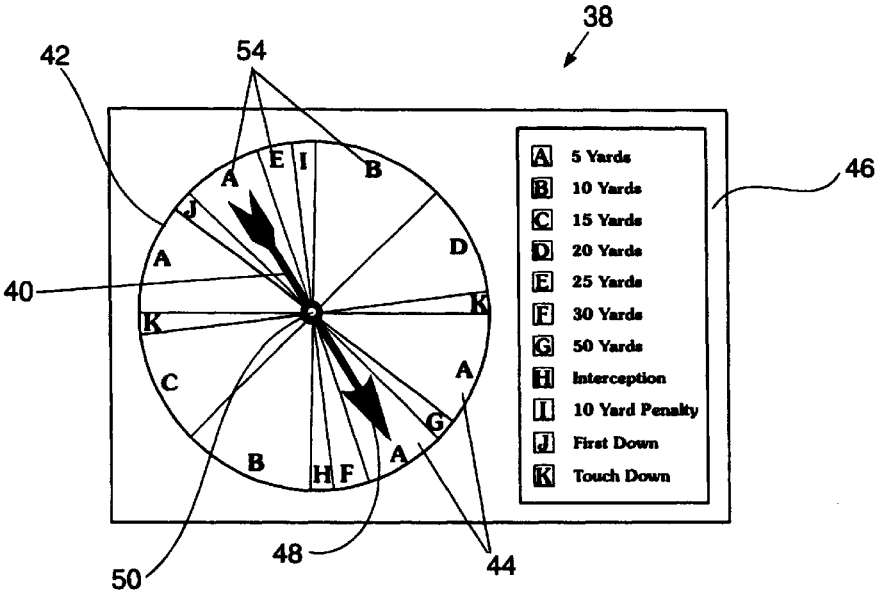
FIG. 4 is a plan view of a play wheel used in accordance with a presently preferred embodiment of the present invention.

It is noted that FIG. 4 merely illustrates an example of a typical wheel and that the wheel can encompass and include a plurality of designs and size changes for the various sectors and sector outcome.

Figure 5:
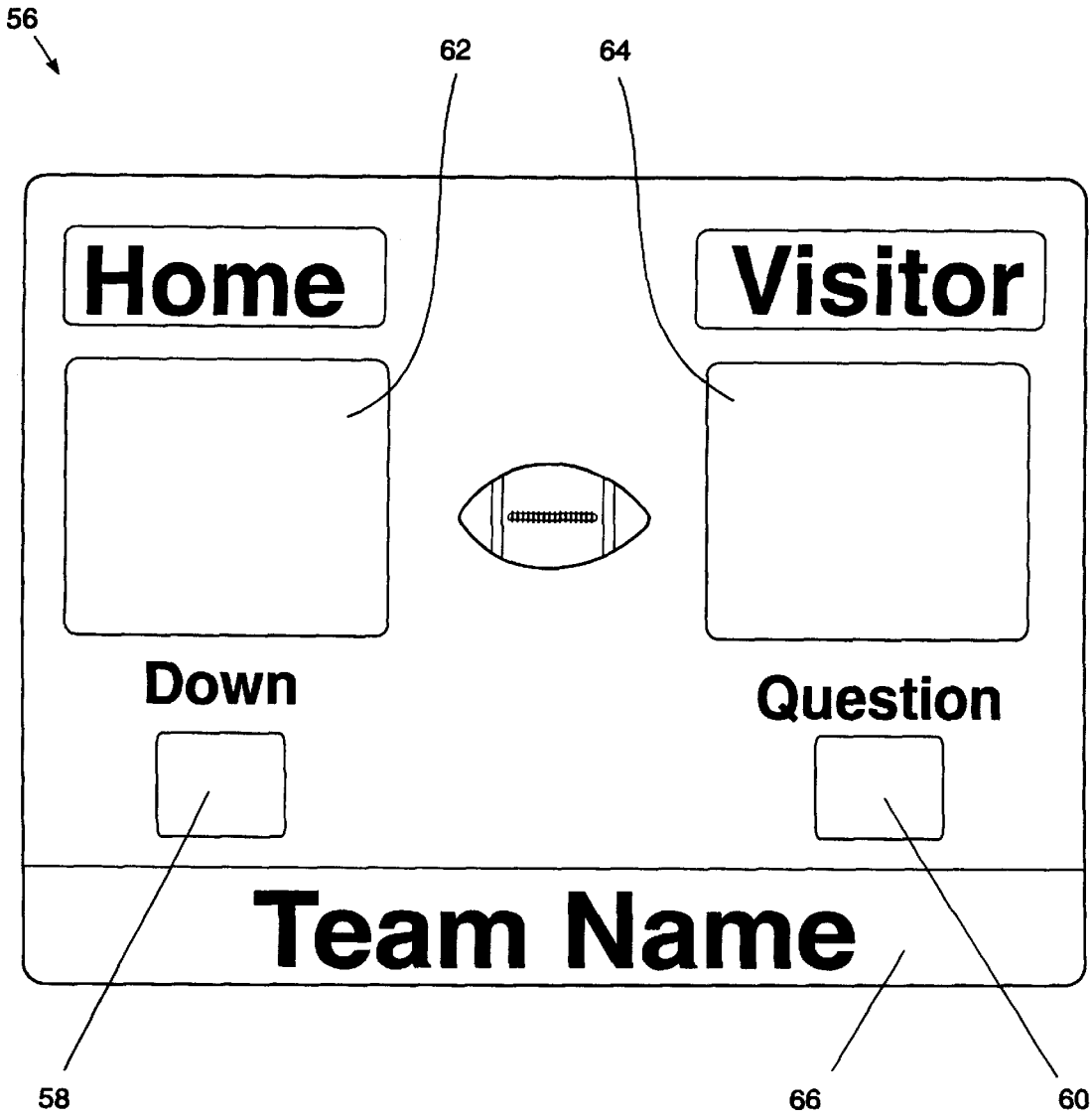
FIG. 5 is a plan view of an scoreboard used in accordance with a presently preferred embodiment of the present invention.

Scoring for the game is kept on a scoreboard 56, as illustrated in FIG. 5. This scoreboard 56 includes a play counter 58, a question counter 60, a portion for home team score 62 and a portion for visitors' team score 64. For football, the play counter 58 counts downs. For other sports, play counters 58 preferably name play terms illustrative of the professional or collegiate sport. Players record changing plays, questions answered correctly and scores by appropriately altering the play counter 58 and the question counter 60, and writing scores on the portion for home team score 62 and the portion for visitors' team score 64. Preferably, players write with erasable tools like chalk, dry-erase markers, graphite pencils, grease pencils, or the like. The scoreboard 56 may also include logos 66, designs or the like.

The game may also be equipped with a timer (not illustrated) for timing the game. The game is designed and configured to last approximately one hour or four 15 minute quarters.

The team sports board games 10 of the present invention may include various configurations for the play boards 12, various configuration for the team banners 32*a* and 32*b*, various configuration for the spin wheels 38, various configurations for the game pieces 37, various embodiments for the play cards 14, and various designs and structure for the scoreboard 56, depicting multiple teams of one sport or depicting multiple sports. For example, the play board may include a football field on a front side and a basketball court on the opposite side.

Similarly, team sports board games 10 of the present invention may be manufactured, supplied, and played in various forms. Considerations for final and appropriate form include manufacturing convenience, manufacturing cost, player convenience and player cost. In addition to the "hardware" game described here, the team sport board game 10 may be made and played in "software" form, preferably using compact disk storage media having a program or programs to mirror each of the "hardware" game elements necessary to practice the present invention.

PREFERRED MODE OF PLAY

The following are suggested, but not mandatory, as some of the more pertinent rules and mode of playing a simulated football game with the present game apparatus.

KICKOFF

Before commencing play, players are divided into teams, and the playing cards 14 are shuffled and split between the teams. The coin 36, or other means of selecting the order of play by chance, identifies a kicking team (defensive) and a receiving team (offensive). Following the rules in professional or collegiate football, teams reverse kicking and receiving stations when second half of play begins. The timer or a watch may be started for limiting the total time of play to one hour.

Player(s) on receiving teams may roll the dice 18 to measure attempted kickoff returns. Prior to rolling the dice, a player on the receiving team calls "even" or "odd". "Even" represents an even numeral for the total number of dots on the dice, while "odd" represents an odd numeral for the total number of dots on the dice. For example, if the player rolls a two (2) and five (5), the total will be seven (7) or odd. If the player rolls a six (6) and two (2), the total will be eight (8) or even.

If the player predicts the "even" or "odd" correctly, the matching roll of the dice is rewarded with yards equaling the addition of the numeral on the dice, multiplied by five, measured from the goal line of the receiving team. For example, if the numeral rolled were two (2) and five (5), then the total yardage will be 35 yards (2+5=7×5=35). The playing piece 37 (or coin 36) is placed on the appropriate yardage line 28, in this example, the play piece would be placed on the 35 yard line.

If the player does not predict the outcome correctly, the receiving team advances to the "10" yard line. Accordingly, the playing piece 37 (or coin 36) is placed on the yardage line which represents the 10 yard line.

Alternatively, the player may also have the option of predicting a total number of dots which may be indicated on the dice. If the player predicts the total number correctly (i.e. the player calls "seven (7)" and the roll of the dice is a six (6) and one (1)), then the team is rewarded a touchdown.

Optionally, the players may elect to permit the rolling of double sixes to be equivalent to a touchdown. Additionally, a player may elect not to roll the dice and automatically start at the "20" yard line. This will allow the player(s) to place the playing piece 37 (or coin 36) on the yardage line which represents the 10 yard line.

ADVANCING YOUR TEAM

Like professional or collegiate football, offensive player (s) consume four downs attempting to score or obtain first downs. For each play, an opposing team member (defensive team) will ask a question 16 from a play card 14. Offensive player(s) offering the correct answer spin the spinning arrow 40 connected to wheel 38 to determine the move's outcome. If the offensive player(s) answer incorrectly, then the offensive team loses a down. Spinning the wheel 38 may result in an automatic first down, a touchdown, a penalty, or an interception. If an interception is spun, the opposing teams is granted a free spin to determine the yardage (or move) it may advance from the previous location of the offensive team.

FIRST DOWNS

The first down is achieve once a player answers three of the four question correctly. The first down may also be earned by landing on the appropriate sector or region on the wheel 38.

SCORING

Scoring may be achieved by either a touchdown, an extra point (after a touchdown is scored), a two-point conversion (after a touchdown is scored), a field goal, or a safety.

A touchdown is worth six points and is achieved once a person advances the play piece to or beyond the goal line of the opposing team.

After a touchdown is made, a player may elect to attempt an extra point or a two-point conversion. An extra point is earned when a player rolls the dots on the dice do not add up to seven (7). A two-point conversion occurs when the player(s) elects to state "odd" or "even" prior to the roll of the dice. If the dice matches the predicted roll, then the two-point conversion is earned.

Field goals can be attempted from as far as the 50 yard line. For attempting a field goal, a player rolls the dice and multiplies the outcome (or each dot on the dice) by five (5). This multiplied number is the total yardage run. If that yardage is not ten yards past the goal line, the kick is considered short, and points are not rewarded. The opposing team then takes over from the location of the attempted field goal.

A safety may also be scored when the opposing team is pushed back to its own goal line or into its own end zone.

While the invention has been particularly shown and described with reference to the embodiments thereof, it will be understood by those skilled in the art that various changes in form and detail may be made without departing from the spirit and scope of the invention.

I claim:

1. A board game for playing a simulated team sport game comprising:

a playing board modeling a team sport playing field;

a plurality of play cards having a plurality of questions and a corresponding plurality of correct answers to said plurality of questions;

a pair of dice used for initializina said board game and determining supplemental moves;

a game piece position marker that is adapted to move on said playing board;

a move wheel including a spinning arrow having an arrow head and a circle divided into a plurality of sectors;

said spinning arrow is centrally and rotatably connected to said circle;

each of said plurality of sectors having an indicium for determining advancement of said game piece position marker; and said plurality of sectors having sizes statistically representative of expected consequences of professional or collegiate team sport play.

2. A board game as in claim 1 further comprising a first receptacle located at a first end of said playing board and a second receptacle located at a second end of said playing board opposite from said first receptacle, and a plurality of team banners are adapted to be removably insertable into each of said first receptacle and said second receptacle.

3. A board game as in claim 1 further comprising a timer for efficiently timing said board game.

4. A board game as in claim 1 further comprising a scoreboard for tracking scores and correct questions answered.

5. A board game as in claim 1 further comprising a means for selecting order of play.

6. A board game as in claim 5 wherein said means for selecting order of play by chance includes a token having a first side and a second side, said first side includes a first design and said second side includes a second design, and said first design is different from said second design.

7. A board game as in claim 1 wherein a ledger is provided for analysis of each of said indicium located on said plurality of sectors.

8. A board game as in claim 1 wherein said playing board models a football playing field and includes a first indicating means of indicating yard lines and a second indicating means for indicating goal lines.

9. A board game as in claim 8 wherein said plurality of play cards include a first and second set of play cards, said first set of play cards includes a plurality of questions and answers related to a first professional or collegiate football team and said second set of play cards includes a plurality of questions and answers related to a second professional or collegiate football team.

10. A board game as in claim 9 further comprising a scoreboard for tracking scores, downs and correct questions answered.

11. A board game as in claim 10 further comprising a first receptacle located at a first end of said playing board and a second receptacle located at a second end of said playing board opposite from said first receptacle, and a plurality of team banners are adapted to be removably insertable into each of said first receptacle and said second receptacle.

12. A board game as in claim 11 further comprising a timer for efficiently timing said board game.

13. A board game as in claim 1 wherein said plurality of play cards include a first and a second set of play cards, said first set of play cards includes a plurality of questions and answers related to a first professional or collegiate football team and said second set of play cards includes a plurality of questions and answers related to a second professional or collegiate football team.

* * * * *